US010655899B2

(12) United States Patent
Kurokawa et al.

(10) Patent No.: US 10,655,899 B2
(45) Date of Patent: May 19, 2020

(54) OIL SEPARATOR

(71) Applicant: Samsung Electronics Co., Ltd., Suwon-si, Gyeonggi-do (KR)

(72) Inventors: Takamitsu Kurokawa, Yokohama (JP); Hisashi Takeichi, Yokohama (JP); Hiroaki Eguchi, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/218,753

(22) Filed: Jul. 25, 2016

(65) Prior Publication Data

US 2017/0184331 A1 Jun. 29, 2017

(30) Foreign Application Priority Data

Dec. 25, 2015 (JP) ..... 2015-254229
Feb. 23, 2016 (KR) ..... 10-2016-0021486

(51) Int. Cl.
*F25B 43/02* (2006.01)

(52) U.S. Cl.
CPC ..... *F25B 43/02* (2013.01); *F25B 2500/01* (2013.01)

(58) Field of Classification Search
CPC ..... F25B 43/02; F25B 13/00; F25B 31/004; F25B 2400/02; F04C 29/026
See application file for complete search history.

(56) References Cited

U.S. PATENT DOCUMENTS 3,633,377 A * 1/1972 Quick ..... F25B 31/004 62/192
4,506,523 A * 3/1985 DiCarlo ..... F04B 39/16 210/167.02

(Continued)

FOREIGN PATENT DOCUMENTS

CN 1388888 1/2003
CN 1877230 12/2006

(Continued)

OTHER PUBLICATIONS

International Search Report and Written Opinion dated Oct. 12, 2016 in corresponding International Patent Application No. PCT/KR2016/007956.

(Continued)

*Primary Examiner* — Kun Kai Ma
(74) *Attorney, Agent, or Firm* — Staas & Halsey LLP

(57) ABSTRACT

An oil separator includes a container having an inner circumferential surface of a cylindrical shape; an inlet pipe that penetrates through from an outside of the container to an inside of the container, comprises an inlet port through which the oil-containing refrigerant is introduced to the container; and a refrigerant discharge pipe that is provided coaxially with a central axis of the container in a top of the container, projects from the top of the container toward a bottom of the container, and comprises a discharge port which is disposed below the inlet port and allows oil removed refrigerant to be discharged. The oil-containing refrigerant flowing out of the inlet port of the inlet pipe is not branched by the refrigerant discharge pipe, and forms a single flow flowing in one direction along an outer circumferential surface of the refrigerant discharge pipe and the inner circumferential surface of the container.

20 Claims, 14 Drawing Sheets

(56) References Cited

U.S. PATENT DOCUMENTS

| | | | | |
|---|---|---|---|---|
| 5,113,671 | A * | 5/1992 | Westermeyer | F25B 43/02 55/337 |
| 5,551,253 | A * | 9/1996 | Kim | F25B 31/004 55/326 |
| 6,131,405 | A * | 10/2000 | Griffin | F25B 43/02 62/470 |
| 6,574,986 | B2 | 6/2003 | Morimoto et al. | |
| 2002/0134102 | A1* | 9/2002 | Morimoto | B01D 45/12 62/470 |
| 2006/0112724 | A1* | 6/2006 | Chang | B01D 19/0057 62/470 |
| 2006/0196221 | A1* | 9/2006 | Westermeyer | F25B 43/02 62/470 |
| 2011/0011105 | A1* | 1/2011 | Valiya Naduvath | B01D 45/12 62/84 |
| 2017/0051957 | A1* | 2/2017 | Shimasaki | F25B 43/02 |

FOREIGN PATENT DOCUMENTS

| | | | | |
|---|---|---|---|---|
| CN | 203719278 | | 7/2014 | |
| EP | 1312879 | | 5/2003 | |
| EP | 1 724 537 | A1 | 11/2006 | |
| JP | 5-312438 | | 11/1993 | |
| JP | 2004-169983 | | 6/2004 | |
| JP | 2006090673 | A * | 4/2006 | F25B 43/02 |
| JP | 2007-271110 | | 10/2007 | |
| JP | 4033248 | | 11/2007 | |
| JP | 4176694 | | 8/2008 | |
| JP | 4356214 | | 8/2009 | |
| JP | 2011-202876 | | 10/2011 | |
| JP | 2011-247575 | | 12/2011 | |
| JP | 2011247575 | A * | 12/2011 | |
| JP | 2013-148308 | | 8/2013 | |
| JP | 2014-145497 | | 8/2014 | |
| KR | 10-2011-0119553 | | 11/2011 | |

OTHER PUBLICATIONS

Extended European Search Report dated Jun. 13, 2018 in European Patent Application No. 16879107.7.

Chinese Office Action dated Nov. 14, 2019 in Chinese Patent Application No. 201680075815.3.

European Communication dated Jan. 31, 2020 in European Patent Application No. 16879107.7.

* cited by examiner

A- A' CROSS-SECTIONAL VIEW

OIL SEPARATOR

CROSS-REFERENCE TO RELATED APPLICATIONS

This application claims benefit of foreign priority from Japanese Patent Application No. 2015-254229 filed Dec. 25, 2015 in the Japan Patent Office, and claims priority from Korean Patent Application No. 10-2016-0021486 filed Feb. 23, 2016 in the Korean Intellectual Property Office, the disclosures of both of which are incorporated herein by reference in their entireties.

BACKGROUND

1. Field

The present disclosure relates to an oil separator to separate oil from refrigerant discharged from a compressor of a refrigerant circuit.

2. Related Art

An example of an oil separator used in a refrigerant circuit includes a container having a cylindrical shape, an inlet pipe that is disposed to penetrate through a side wall of the container and introduces refrigerant containing oil to turn along an inner circumferential surface of the container, and a refrigerant discharge pipe that is disposed to penetrate through a top wall of the container and discharges the refrigerant from which the oil is separated.

Japanese Patent Publication No. 2011-202876 discloses an oil separator that is configured such that an outer diameter d of the inlet pipe and an outer diameter D of the container satisfies $0.40 \leq d/D \leq 0.44$ in order to improve separation efficiency of the oil.

However, the present inventors have discovered that the above-described configuration of the oil separator does not sufficiently solve the object of improving the separation efficiency of the oil.

As a result of the effort to find out the reason, as illustrated in FIG. 1, it was found that most of the refrigerant introduced from the inlet pipe is turning along the inner circumferential surface of the container but some of the refrigerant flows in the opposite direction of the turning direction of the refrigerant. In other words, it can be seen that the refrigerant flowing into the container trough the inlet pipe is branched by the discharge pipe so that the separation efficiency of the oil is decreased.

SUMMARY

The present disclosure has been developed in order to overcome the above drawbacks and other problems associated with the conventional arrangement. An aspect of the present disclosure relates to an oil separator having an oil separation efficiency that is higher than that of a conventional oil separator.

According to an aspect of the present disclosure, an oil separator may separate oil from oil-containing refrigerant, the oil separator including a container having an inner circumferential surface of a cylindrical shape; an inlet pipe that penetrates through from an outside of the container to an inside of the container, comprises an inlet port through which the oil-containing refrigerant is introduced to the container, and allows the oil-containing refrigerant to flow downward while turning along the inner circumferential surface of the container; and a refrigerant discharge pipe that is provided coaxially with a central axis of the container in a top of the container, projects from the top of the container toward a bottom of the container, and comprises a discharge port which is disposed below the inlet port and allows oil removed refrigerant to be discharged, wherein the oil-containing refrigerant coming out of the inlet port of the inlet pipe is not branched by the refrigerant discharge pipe, and forms a single flow flowing in one direction along an outer circumferential surface of the refrigerant discharge pipe and the inner circumferential surface of the container.

In a cross-section of the oil separator that includes a pipe axis of the inlet pipe and is orthogonal to the central axis, a leading end of the inlet pipe may be located on a first virtual plane parallel to the central axis, and a spacing distance between the first virtual plane and a second virtual plane that is parallel to the first virtual plane and is tangent to the outer circumferential surface of the refrigerant discharge pipe may be at least 0.32 times an inner diameter of the inlet pipe.

When the oil separator is configured as described above, because the spacing distance between the first virtual plane and the second virtual plane is 0.32 times or more the inner diameter of the inlet pipe, some of the refrigerant may be prevented from flowing in an opposite direction of a turning direction as a conventional oil separator so that the separation efficiency may be improved than that of the conventional oil separator. Specific experimental data will be described later.

In order to more reliably turn the refrigerant flowing from the inlet port along the inner circumferential surface of the container, the first virtual plane may be inclined with respect to a surface orthogonal to the pipe axis of the inlet pipe, and the inlet port may be formed toward the refrigerant discharge pipe.

Here, the conventional oil separator may be formed so that the refrigerant discharge pipe extends in a sufficient length toward the bottom of the container in order to prevent the oil-containing refrigerant from being discharged through the refrigerant discharge pipe before the oil is separated.

However, when downsizing the oil separator, with the configuration of the above-described conventional oil separator, there is a problem that oil is not sufficiently separated from the refrigerant.

The present inventors have carefully reviewed the problem, and have found that causes are as follows.

In other words, when using the container of a small size in order to reduce the size of the oil separator, the distance from the discharge port of the refrigerant discharge pipe to the inner circumferential surface of the container is closer. Accordingly, with the configuration of the conventional oil separator in which the refrigerant discharge pipe extends toward the bottom of the container, while the refrigerant is turning along the inner circumferential surface of the container, the turning direction of the refrigerant is changed gradually in the downward direction, and at the time when the oil-containing refrigerant reaches near the discharge port of the refrigerant discharge pipe, the centrifugal force is lowered so that the separated oil is separated away from the inner circumferential surface of the container and flows into the discharge port.

Thus, an oil separator according to an embodiment of the present disclosure may separate oil from oil-containing refrigerant, the oil separator including a container having an inner circumferential surface of a cylindrical shape; an inlet pipe that penetrates through from an outside of the container to an inside of the container, comprises an inlet port through which the oil-containing refrigerant is introduced to the container, and allows the oil-containing refrigerant to flow downward while turning along the inner circumferential surface of the container; and a refrigerant discharge pipe that is provided coaxially with a central axis of the container in a top of the container, projects from the top of the container toward a bottom of the container, and comprises a discharge port which is disposed below the inlet port and allows oil removed refrigerant to be discharged, wherein a height from the discharge port to a center of the inlet port may be 3.0 times or more and 4.5 times or less the inner diameter of the inlet pipe.

With the above-described configuration, since the height from the discharge port to the center of the inlet port is 3.0 times or more the inner diameter of the inlet pipe, the oil-containing refrigerant introduced through the inlet pipe turns along the inner circumferential surface of the container so that oil is separated until reaching the discharge port. In addition, since the height from the discharge port to the center of the inlet port is 4.5 times or less the inner diameter of the inlet pipe, when the oil reaches the height of the discharge port, the oil maintains the flow rate for turning along the inner circumferential surface, so the oil is prevented from being separated from the inner circumferential surface and from flowing into the discharge port.

Also, as the configuration to improve the oil separation efficiency, the refrigerant discharge pipe may be provided coaxially with the central axis of the container, and the spacing distance between the outer circumferential surface of the refrigerant discharge pipe and the inner circumferential surface of the container may be 1.0 times or more and 2.0 times or less an inner diameter of the refrigerant discharge pipe.

Specific experimental data concerning the configuration thereof will be described later.

Even when the amount of the oil-containing refrigerant to be discharged is increased or decreased to some extent in accordance with the size of the compressor, in order not to reduce the oil separation efficiency, the inner diameter of the inlet pipe may be 0.16 times or more and 0.44 times or less the inner diameter of the container.

At this time, if the inner diameter of the inlet pipe is less than 0.16 time the inner diameter of the container, the pressure loss is increased so that the separation efficiency is reduced. If the inner diameter of the inlet pipe is more than 0.44 times the inner diameter of the container, the inlet pipe is so close to the center of the container so that turning of the oil-containing refrigerant is difficult and the separation efficiency is reduced.

The inner diameter of the inlet pipe may be 9.5 mm or more and 22.4 mm or less, and wherein in a cross-section that includes the central axis of the container and is orthogonal to the pipe axis of the inlet pipe, a spacing distance from the pipe axis of the inlet pipe to a portion of the inner circumferential surface of the container that is opposite to the central axis with respect to the pipe axis may be 10.6 mm or more and 13.2 mm or less.

If the spacing distance between the pipe axis of the inlet pipe and the inner circumferential surface of the container is within the above range, the oil-containing refrigerant may be reliably turned.

The container may include a main body portion of a cylindrical shape and a upper tapered portion that is provided at a top end of the main body portion and is reduced in diameter in an upward direction, wherein a height from the top end of the main body portion to the pipe axis of the inlet pipe is lower than a height of the upper tapered portion.

With this configuration, since it is difficult that the oil stays in the upper side of the inlet pipe, the separation efficiency may further be improved.

The container may include a main body portion of a cylindrical shape and a lower tapered portion that is provided in a bottom end of the main body portion, is gradually reduced in diameter in a downward direction, and receives the separated oil, wherein the discharge port of the refrigerant discharge pipe is provided above the lower tapered portion.

With this configuration, even if the oil received in the lower tapered portion is scattered, since the discharge port is provided above the lower tapered portion, it may be difficult that the scattered oil flows into the discharge port.

The inlet pipe may include a front end portion in which the inlet port is formed and that penetrates through a side wall of the container; and a rear end portion that is provided at an upstream side of the front end portion, is bent from the front end portion, and extends in an upper side.

With this configuration, since the rear end portion is bent from the front end portion and extends in the upward direction, the oil flowing along the inner circumferential surface of the inlet pipe is inclined to the lower side by the centrifugal force at the bent portion of the rear end portion.

Because of this, the oil may be prevented from being introduced in the upward direction into the inside of the container, and the oil may be difficult to stay in the upper side of the inlet pipe.

In order to prevent scattering of the separated oil, the oil separator may include an oil scattering prevention plate that is provided in a lower portion of an inside of the container, partitions the inside of the container up and down, is provided with at least one oil passage hole through which oil separated from the oil-containing refrigerant passes.

The oil scattering prevention plate may be formed in a circular plate shape an outer circumferential surface of which corresponds to the inner circumferential surface of the container, and the at least one oil passage hole may be formed in the outer circumferential surface.

With this configuration, the separated oil may be made to flow down through the oil passage hole, and the scattering of the oil may be further reliably prevented.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

Throughout the drawings, like reference numerals will be understood to refer to like parts, components and structures.

DESCRIPTION OF EMBODIMENTS

Hereinafter, certain exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Figure 1:
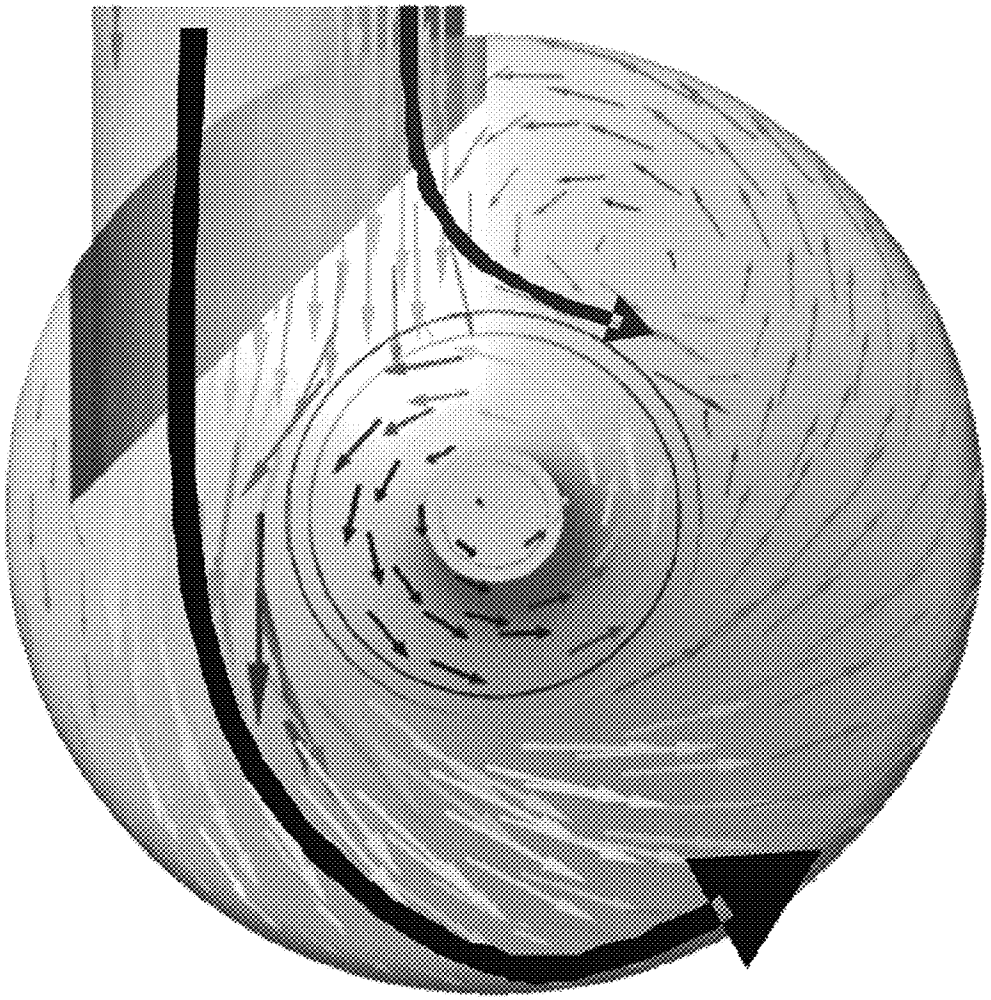
FIG. 1 is a view simulating a flow of an oil-containing refrigerant in a conventional oil separator.
Figure 2:
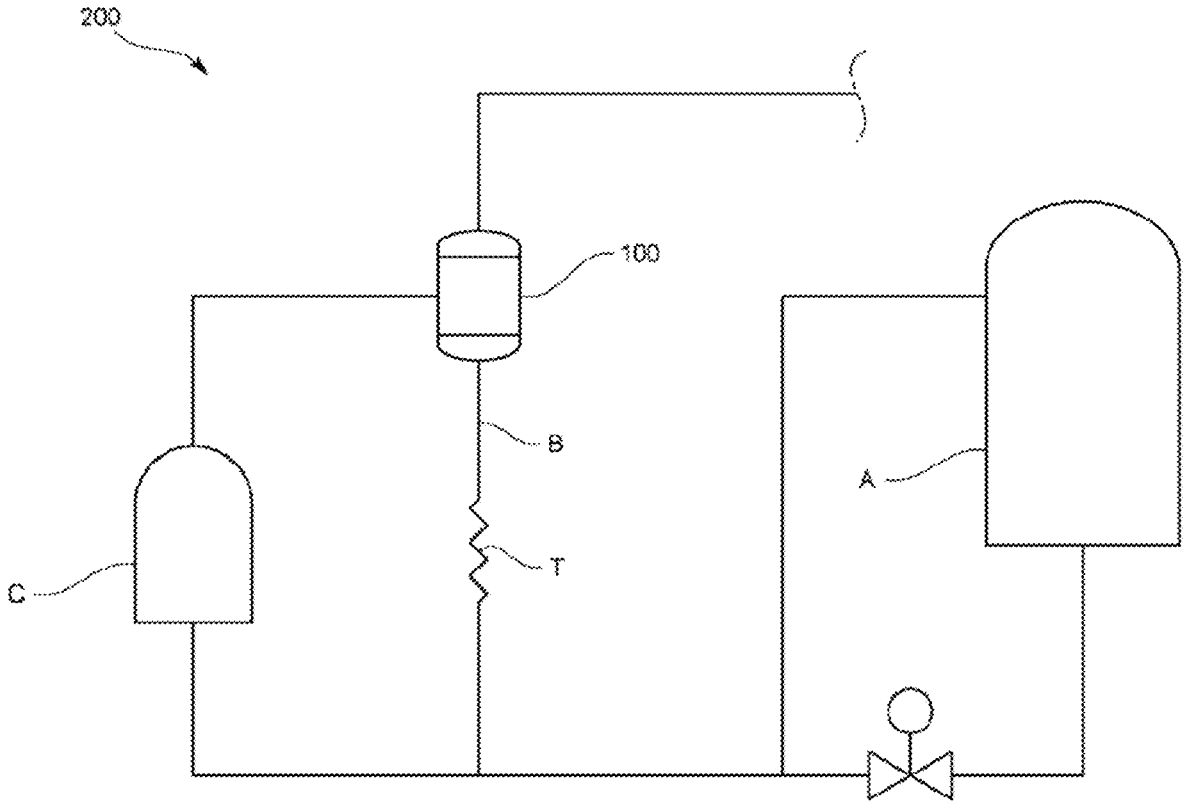
FIG. 2 is a circuit diagram schematically illustrating a refrigerant circuit according to an embodiment of the present disclosure.

FIG. 2 is a circuit diagram schematically illustrating a refrigerant circuit according to an embodiment of the present disclosure.

As illustrated in FIG. 2, an oil separator 100 according to an embodiment of the present disclosure may configure a refrigerant circuit 200 of an air conditioner together with a compressor C, an accumulator A, and like. The oil separator 100 is disposed in the downstream of the compressor C, and separates oil from refrigerant containing oil (hereinafter, also referred to as oil-containing refrigerant) that is discharged from the compressor C.

In detail, the oil separator 100 is configured to centrifugally separate oil from the oil-containing refrigerant by using an centrifugal force, to discharge the refrigerant from which the oil has separated (hereinafter, referred to as refrigerant after separation) to, for example, a heat exchanger that is not illustrated, and to simultaneously return the separated oil to the compressor C.

Also, the refrigerant circuit 200 includes a return pipe B that connects the oil separator 100 and the compressor C and returns the separated oil to the compressor C, and a capillary pipe T that is provided in the return pipe B. Almost all of the separated oil flows through the capillary pipe T and goes back to the compressor C.

Figure 3:
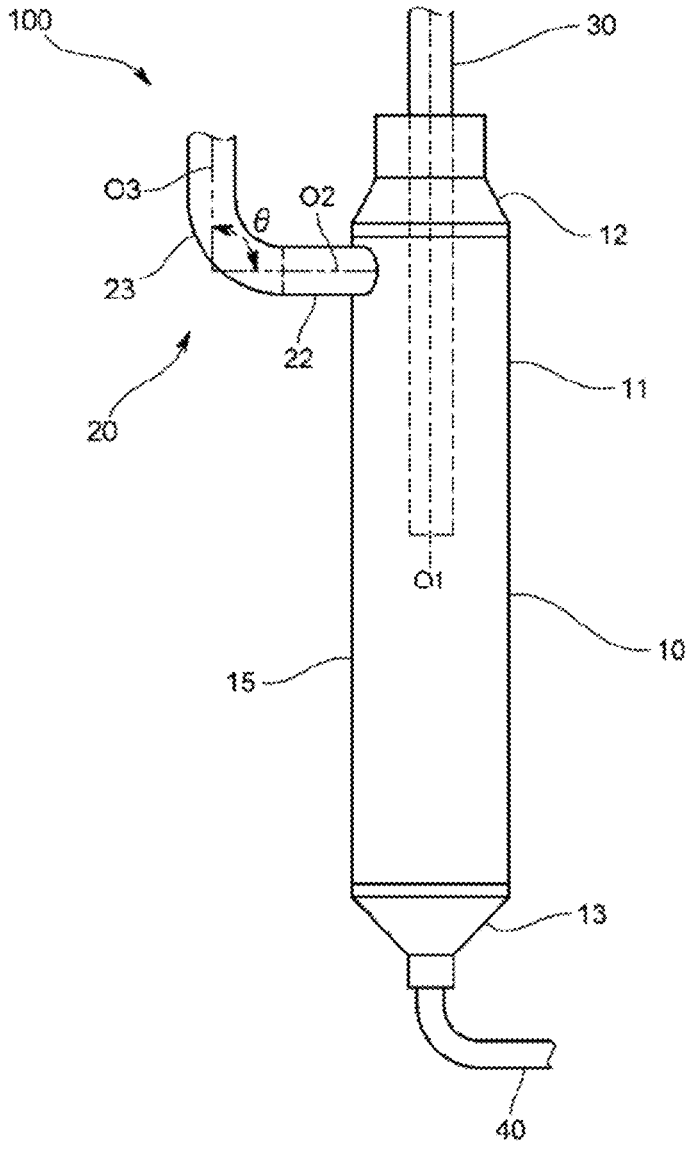
FIG. 3 is a view schematically illustrating an oil separator according to an embodiment of the present disclosure.
Figure 4:
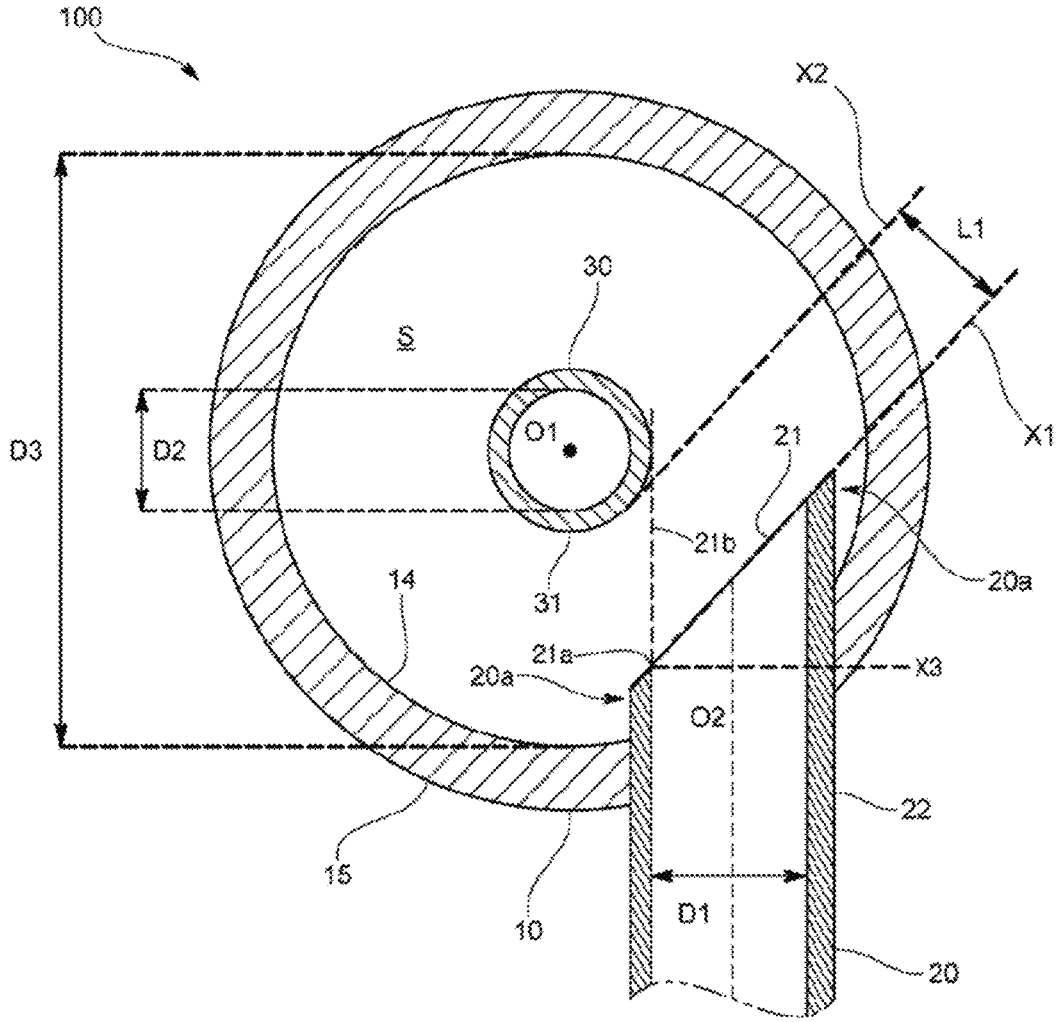
FIG. 4 is a cross-sectional view illustrating an oil separator according to an embodiment of the present disclosure.
Figure 5:
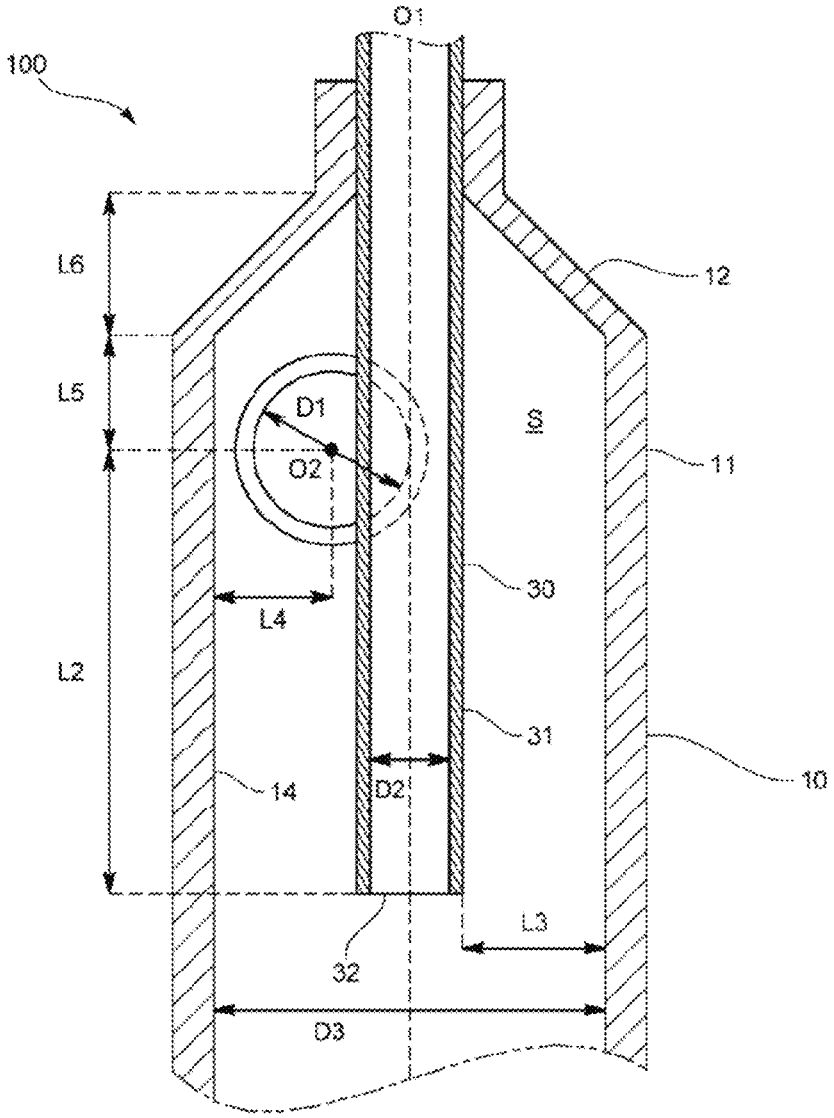
FIG. 5 is a cross-sectional view illustrating an oil separator according to an embodiment of the present disclosure.

More specifically, the oil separator 100, as illustrated in FIGS. 3, 4, and 5, includes a container 10 having a separation space S for separating the oil from the oil-containing refrigerant, an inlet pipe 20 that introduces the oil-containing refrigerant into an inside of the container 10, a refrigerant discharge pipe 30 that discharges the refrigerant after separation from the container 10, and an oil discharge pipe 40 that discharges the separated oil from the container 10.

Hereinafter, the oil separator 100 according to an embodiment of the present disclosure will be described in detail with reference to FIGS. 3, 4, and 5.

FIG. 3 is a view schematically illustrating an oil separator according to an embodiment of the present disclosure. FIG. 4 is a cross-sectional view illustrating an oil separator according to an embodiment of the present disclosure. FIG. 5 is a cross-sectional view illustrating an oil separator according to an embodiment of the present disclosure.

As illustrated in FIG. 3, the container 10 includes a main body portion 11 that is formed in a substantially cylindrical shape, the top end and bottom end of which are opened, and has a uniform cross-sectional shape, an upper tapered portion 12 that is provided in a top end of the main body portion 11 and is gradually decreased in diameter toward an upward direction, and a lower tapered portion 13 that is provided in a bottom end of the main body portion 11 and is gradually decreased in diameter toward a downward direction. The lower tapered portion 13 receives the oil separated from the container 10.

The container 10, as illustrated in FIGS. 4 and 5, has an inner circumferential surface 14 a cross-section of which is orthogonal to the central axis O1 of the container 10 and forms a circular shape. The separation space S of the container 10 is formed by the inner circumferential surface 14. The oil-containing refrigerant flows from top to bottom while turning along the inner circumferential surface 14 of the container 10.

As illustrated in FIGS. 3 and 4, the inlet pipe 20 introduces the oil-containing refrigerant into the inside of the container 10 so that the oil-containing refrigerant turns along the inner circumferential surface 14 of the container 10. The inlet pipe 20 is disposed to penetrate through a side wall 15 of the container 10. The inlet pipe 20 according to the present embodiment penetrates through a portion below the upper tapered portion 12, more specifically, through an upper portion of the main body portion 11, and projects into the inside of the container 10. The inlet pipe 20 is disposed so that a pipe axis O2 of the inlet pipe 20 is orthogonal to the central axis O1 the container 10.

In detail, the inlet pipe 20 has an inlet port 21 to introduce the oil-containing refrigerant into the inside of the container 10, and is formed in a cylindrical pipe with a circular cross-section. The inlet pipe 20 includes a front end portion 22 that is provided with the inlet port 21 and penetrates the side wall 15 of the container 10 so that a leading end of the front end portion 22 is located inside the container 10, and a rear end portion 23 that is provided continuously toward an upstream side of the front end portion 22. The rear end portion 23 is formed to be curved in a height direction of the container 10 from the front end portion 22 and to extend in the upward direction.

In more detail, the inlet pipe 20 is disposed so that the pipe axis O2 of the front end portion 22 of the inlet pipe 20 does not intersect with the central axis O1 of the container 10 so that the oil-containing refrigerant is discharged in the tangential direction of the inner circumferential surface 14 from the inlet port 21. In other words, the pipe axis O2 of the front end portion 22 is spaced apart from the central axis O1 of the container 10. Here, the pipe axis O2 of the front end portion 22 is orthogonal to the central axis O1 of the container 10, and an angle θ formed by the pipe axis O2 of the front end portion 22 and a pipe axis O3 of a linear portion of the rear end portion 23 is approximately 90 degrees. Also, the angle θ between the front end portion 22 and the rear end portion 23 of the inlet pipe 20 may be appropriately changed in a range between more than 0 and less than 180 degrees.

In the present embodiment, referring to FIG. 4, in a cross-section that includes the pipe axis O2 of the inlet pipe 20 and is orthogonal to the central axis O1 of the container 10, the leading end 20*a* of the inlet pipe 20 in which the pipe axis O2 is sandwiched is located on a first virtual plane X1 parallel to the central axis O1 of the container 10.

In more detail, the inlet port 21 is formed on the first virtual plane X1 parallel to the central axis O1 of the container 10, and is opened to be inclined with respect to a virtual plane X3 orthogonal to the pipe axis O2 of the inlet pipe 20, thereby facing the outer circumferential surface 31 of the refrigerant discharge pipe 30.

The refrigerant after separation from which oil is removed flows from bottom to top through the refrigerant discharge pipe 30. As illustrated in FIGS. 4 and 5, the refrigerant discharge pipe 30 is stably inserted in an opening (not illustrated) formed in the top of the container 10, and is disposed coaxially with the central axis O1 of the container 10.

In detail, the refrigerant discharge pipe 30 is formed in a cylindrical pipe that has an outer diameter smaller than the inner diameter of the container 10 and a uniform cross-section. The refrigerant discharge pipe 30 is provided with a discharge port 32 that is located inside the container 10 and into which the refrigerant after separation is introduced. In other words, the refrigerant discharge pipe 30 is disposed coaxially with the central axis O1 of the container 10 in the top of the container 10, projects toward the bottom of the container 10 from the top of the container 10, and is provided with the discharge port 32 that is located below the inlet port 21 and through which the refrigerant from which the oil is removed is discharged.

The discharge port 32 of the refrigerant discharge pipe 30 is provided at a position a certain distance from the top of the container 10. In the present embodiment, the discharge port 32 is located so that the internal volume of the container 10 below the discharge port 32 is 0.6 L or less.

Also, in the present embodiment, the discharge port 32 is provided to be positioned above the lower tapered portion 13 as described above, that is, above the bottom end of the main body portion 11. Accordingly, even when the oil received in the lower tapered portion 13 is scattered, the scattered oil does not flow into the discharge port 32.

The oil discharge pipe 40 is to discharge the oil received in the lower tapered portion 13 of the container 10 from the container 10 to the outside, and, as illustrated in FIG. 3, is provided in the lower tapered portion 13.

In detail, the oil discharge pipe 40 is inserted stably in a bottom opening (not illustrated) formed in the bottom of the container 10, and is formed in a cylindrical pipe with a uniform cross-sectional shape.

Figure 7:
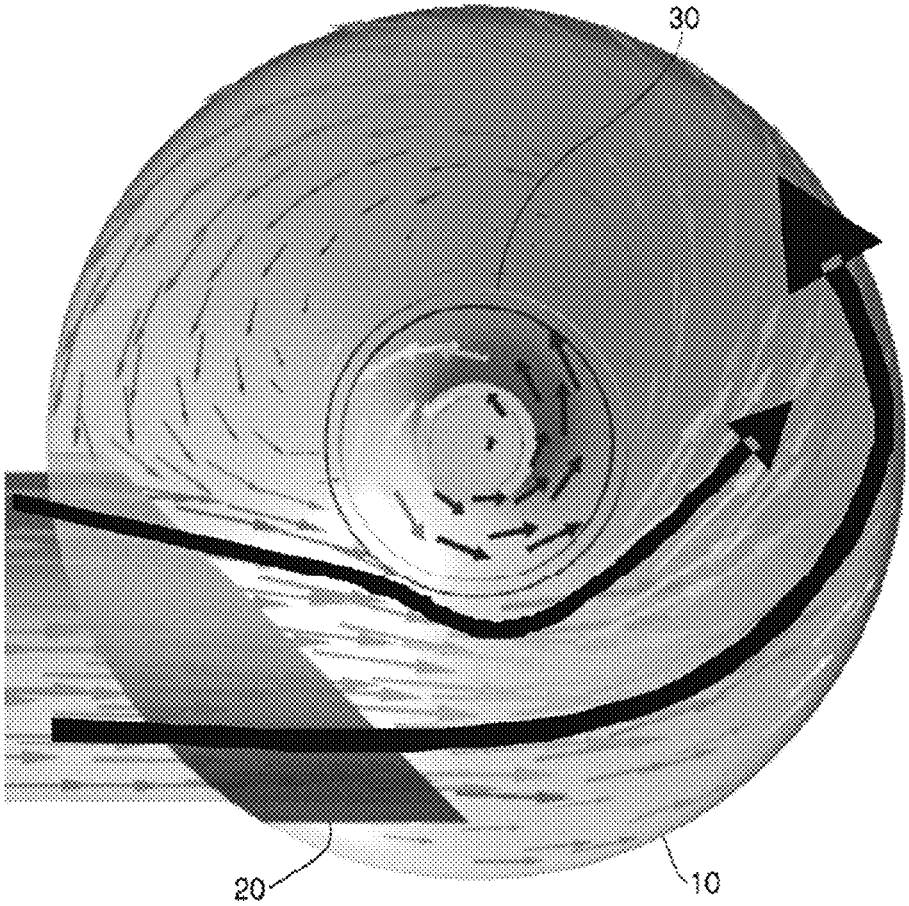
FIG. 7 is a view simulating a flow of an oil-containing refrigerant in an oil separator according to an embodiment of the present disclosure.

The oil separator 100 according to an embodiment of the present disclosure is formed so that the oil-containing refrigerant coming out from the inlet port 21 of the inlet pipe 20 is not branched into two refrigerant flows by the refrigerant discharge pipe 30, but, as illustrated in FIG. 7, forms a single refrigerant flow that flows in one direction along the inner circumferential surface 14 of the container 10 and the outer circumferential surface 31 of the refrigerant discharge pipe 30. For example, as illustrated in FIG. 4, the inlet pipe 20 may be disposed so that a virtual straight line 21*b*, which extends from one end 21*a* of the inlet port 21 adjacent to the central axis O1 of the container 10 and is parallel to the pipe axis O2, interferes with the outer circumferential surface 31 of the refrigerant discharge pipe 30, and does not exceed the central axis O1.

As illustrated in FIG. 3, the oil separator 100 according to the present embodiment is configured so that a spacing distance L1 between the first virtual plane X1 and a second virtual plane X2 that is tangent to the outer circumferential surface 31 of the refrigerant discharge pipe 30 and is parallel to the first virtual plane X1 is 0.32 times or more the inner diameter D1 of the inlet pipe 20.

In more detail, the spacing distance L1 is 0.32 times or more the inner diameter D1 of an end portion of the inlet port side of the inlet pipe 20.

Figure 6:
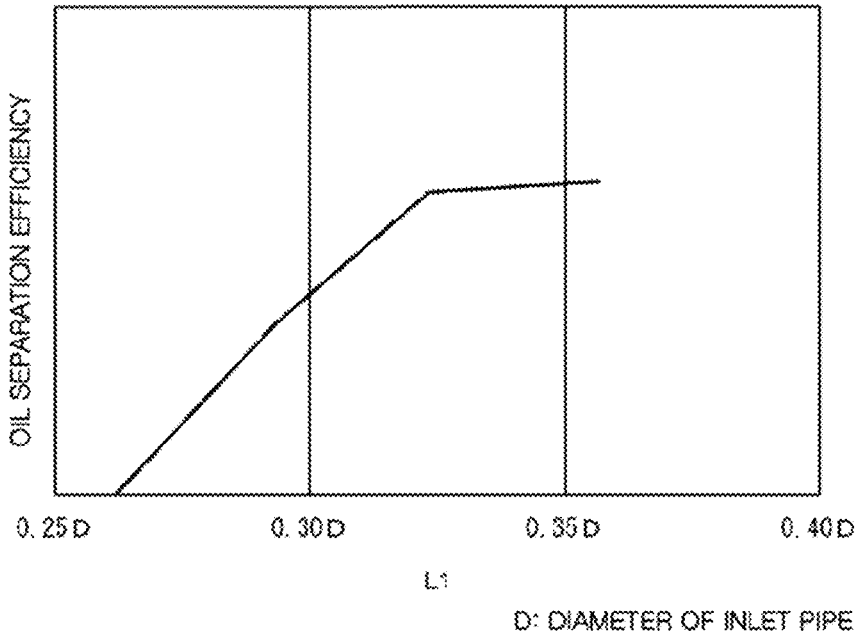
FIG. 6 is a graph of experimental data illustrating an effect of an oil separator according to an embodiment of the present disclosure.

Here, a graph of experimental data showing the relationship between oil separation efficiency and the spacing distance L1 between the first virtual plane X1 and the second virtual plane X2 is illustrated in FIG. 6. The result of simulating the flow of the oil-containing refrigerant is illustrated in FIG. 7.

The experimental data shown in FIG. 6 assumed a state in which the flow rate of the oil (the refrigerant flow rate multiplied by the oil lubrication rate) that is introduced into the oil separator 100 is large. The experimental conditions were that the refrigerant flow rate is 1000 kg/h, the oil lubrication rate is 1.4%, and the inner diameter D1 of the inlet pipe 20 is 17.05 mm. Also, FIG. 7 illustrates a result of a computer simulation performed under a condition in which the spacing distance L1 is 0.32 times the inner diameter D1 of the inlet pipe 20.

As can be seen in the graph of the experimental data illustrated in FIG. 6, there is a trend in which when the spacing distance L1 is gradually increased, the oil separation efficiency is improved until about 0.32 times the inner diameter D1 of the inlet pipe 20, and is not substantially changed more than the 0.32 times.

This trend is caused by that almost all of the oil-containing refrigerant introduced into the inlet pipe 20 flows to only one of the left side and the right side of the refrigerant discharge pipe 30, and turns in the same direction as illustrated in FIG. 7. In the case of FIG. 7, almost all of the oil-containing refrigerant introduced into the inlet pipe 20 flows to the right side of the refrigerant discharge pipe 30 and turns counterclockwise.

Also, the oil separator 100 according to the present embodiment may be configured so that a height from the discharge port 32 to the center of the inlet port 21, that is, the height L2 from the discharge port 32 to the pipe axis O2 of the inlet pipe 20 is at least 3.0 times and not more than 4.6 times of the inner diameter D1 of the inlet pipe 20. More specifically, the height L2 from the discharge port 32 to the pipe axis O2 of the inlet pipe 20 may be at least 3.0 times and not more than 4.0 times of the inner diameter D1 of the inlet pipe 20.

Figure 8:
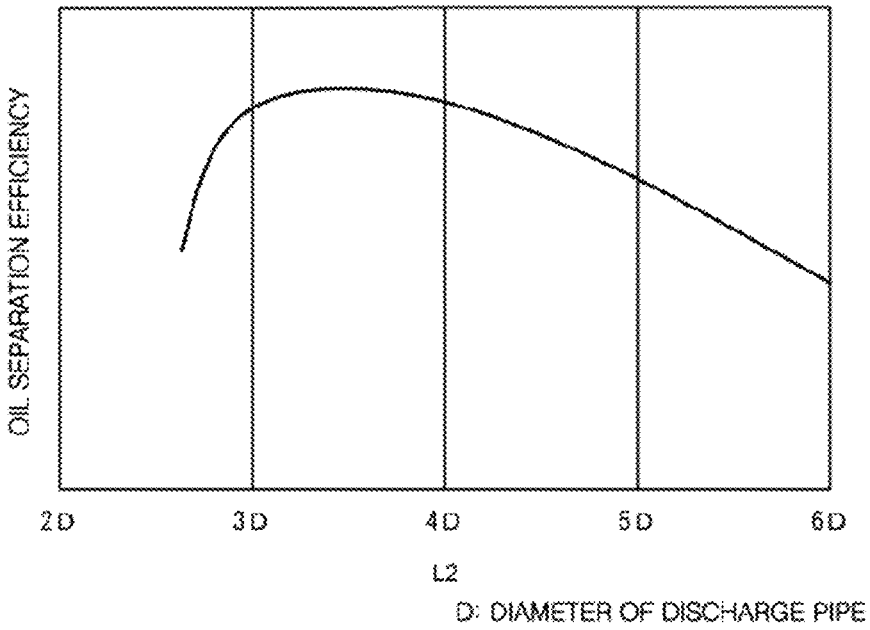
FIG. 8 is a graph of experimental data illustrating an effect of an oil separator according to an embodiment of the present disclosure.

Here, a graph of experimental data showing the relationship between the height L2 and the oil separation efficiency is illustrated in FIG. 8. Also, the experimental condition is the same as that of the above-described oil separator 100.

As can be seen in the graph of the experimental data illustrated in FIG. 8, the oil separation efficiency of the oil separator 100 rises as the height L2 increases. However, when the height L2 is more than 3.0 times the inner diameter D1 of the inlet pipe 20, the oil separation efficiency is not substantially changed. There is a tendency that the oil separation efficiency is gradually decreased when the height L2 is more than 4.0 times the inner diameter D1.

This tendency is caused by that when the height L2 is smaller than 3.0 times the inner diameter D1 of the inlet pipe 20, the oil is discharged along with the refrigerant through the refrigerant discharge pipe 30 before the oil is separated from the oil-containing refrigerant. Further, the tendency is caused by that when the height L2 is more than 4.0 times the inner diameter D1 of the inlet pipe 20, while the refrigerant introduced through the inlet pipe 20 is turning along the inner circumferential surface 14 of the container 10, the turning direction of the refrigerant is changed gradually in the downward direction, and at the time when the oil-containing refrigerant reaches near the discharge port 32 of the refrigerant discharge pipe 30, the centrifugal force of the oil-containing refrigerant is lowered so that the separated oil is separated away from the inner circumferential surface 14 of the container 10 and flows into the discharge port 32.

Also, in the present embodiment, the height L2 from the discharge port 32 to the pipe axis O2 of the inlet pipe 20 may be determined by using the flow rate of refrigerant flowing the inlet pipe 20, the spacing distance L3 between the outer circumferential surface 31 of the refrigerant discharge pipe 30 and the inner circumferential surface 14 of the container 10, and the inner diameter D1 of the inlet pipe 20 as parameters.

In detail, when the flow rate of the refrigerant being introduced through the inlet pipe 20 is 6.0 m/s or more and the spacing distance L3 is at least 1.0 times and not more than 2.0 times of the inner diameter D2 of the refrigerant discharge pipe 30, the height L2 may be determined to be at least 3.0 times and not more than 4.0 times of the inner diameter D1 of the inlet pipe 20 as described above. With this configuration, the oil separator 100 may be downsized, and the oil separation efficiency of the oil separator 100 may be improved.

Figure 9:
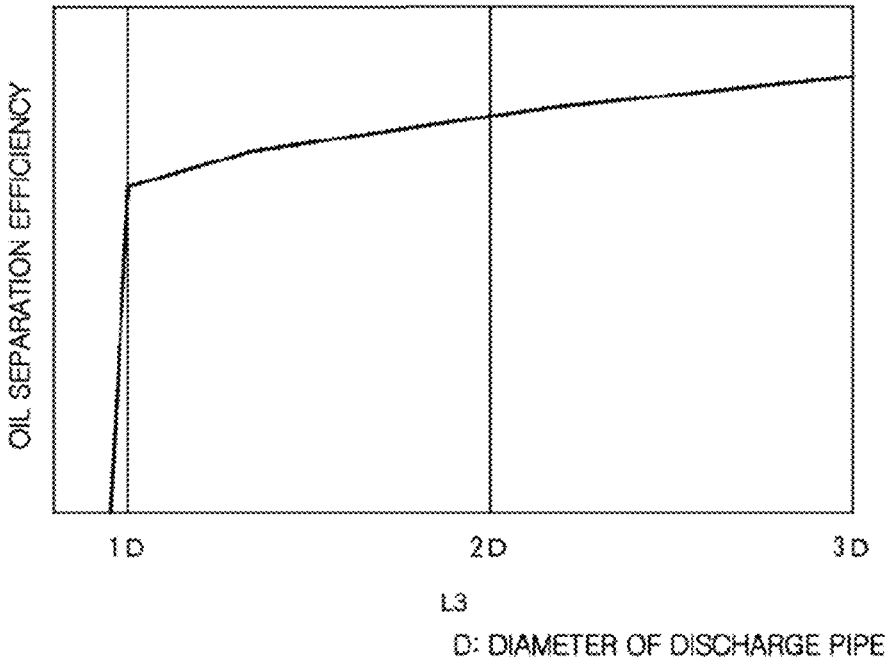
FIG. 9 is a graph of experimental data illustrating an effect of an oil separator according to an embodiment of the present disclosure.

Here, a graph of experimental data showing the relationship between the oil separation efficiency and the spacing distance L3 between the outer circumferential surface 31 of the refrigerant discharge pipe 30 and the inner circumferential surface 14 of the container 10 is illustrated in FIG. 9. At this time, the experimental condition is the same as that of the above-described oil separator 100.

As can be seen in the graph of the experimental data illustrated in FIG. 9, the oil separation efficiency of the oil separator 100 may have a tendency to greatly increase when the spacing distance L3 is 1.0 times or more the inner diameter D2 of the refrigerant discharge pipe 30.

This tendency is caused by that when the spacing distance L3 is less than 1.0 times the inner diameter D2 of the refrigerant discharge pipe 30, the separated oil flows into the discharge port 32 of the refrigerant discharge pipe 30.

Also, in the oil separator 100 according to an embodiment of the present disclosure, the inner diameter D1 of the inlet pipe 20 may be 0.16 times or more and not more than 0.44 times of the inner diameter D3 of the container 10. Here, the inner diameter D3 of the container 10 is, for example, 50.8 mm.

In more specifically, the inner diameter D1 of the inlet pipe 20 may be 9.5 mm or more and not more than 22.4 mm. Also, in a cross-section that includes the central axis O1 of the container 10 and is orthogonal to the pipe axis O2 of the inlet pipe 20, the spacing distance L4 from the pipe axis O2 to a portion of the inner circumferential surface 14 that is opposite to the central axis O1 with respect to the pipe axis O2 may be 10.6 mm or more and not more than 13.2 mm.

If the inlet pipe 20 is formed as described above, the oil-containing refrigerant flowing from the inlet pipe 20 into the container 10 may reliably turn along the inner circumferential surface 14 of the container 10, and the oil separation efficiency may be improved.

In addition, in the present embodiment, in order to prevent oil from staying on the upper side of the inlet pipe 20, a height L5 from the top end of the main body portion 11, that is, the bottom of the upper tapered portion 12 to the pipe axis O2 of the inlet pipe 20 may be formed to be smaller than a height L6 of the upper tapered portion 12.

Figure 10:
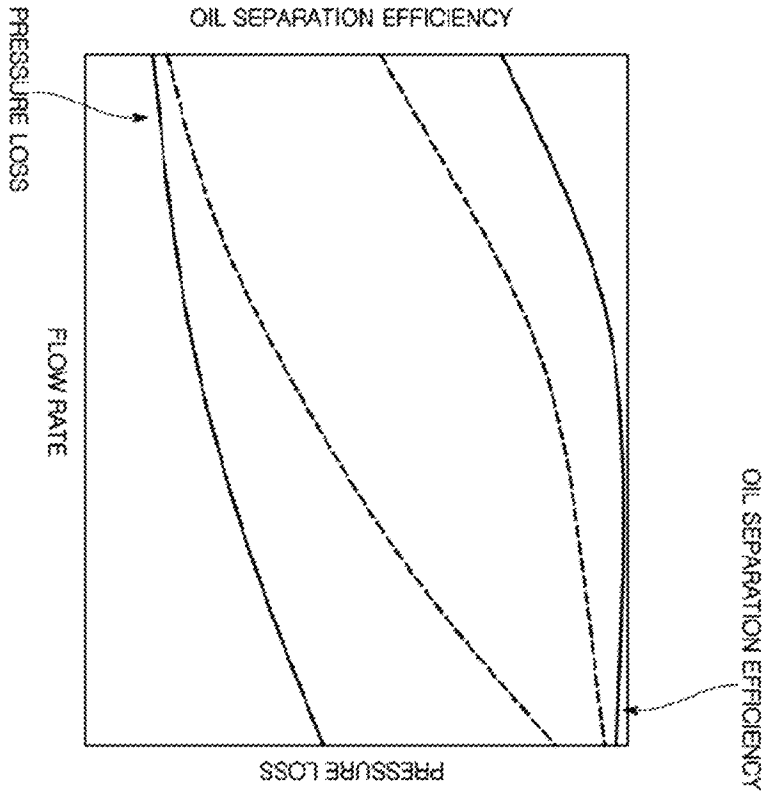
FIG. 10 is a graph of experimental data illustrating an effect of an oil separator according to an embodiment of the present disclosure.

Here, a graph of experimental data comparing the oil separator 100 according to the present embodiment with the conventional oil separator is illustrated in FIG. 10.

As can be seen in the graph of the experimental data illustrated in FIG. 10, the oil separator 100 according to the present embodiment can prevent some of the oil-containing refrigerant being introduced through the inlet pipe 20 from flowing in the opposite direction to the turning direction as the conventional oil separator so that the pressure loss may be reduced compared to that of the conventional oil separator. For reference, in FIG. 10, the dashed lines represent the pressure loss and the oil separation efficiency of the conventional oil separator, and the solid lines represent the pressure loss and the oil separation efficiency of the oil separator 100 according to an embodiment of the present disclosure.

Accordingly, even when the flow rate of the oil-containing refrigerant flowing in the oil separator 100 is rapid, the pressure loss may be suppressed, the oil may be efficiently separated from the oil-containing refrigerant by using a large centrifugal force in accordance with the rapid flow rate, and further the oil separator 100 may be downsized.

Also, when the oil separator 100 is downsized so that the volume of the container 10 below the discharge port 32 of the refrigerant discharge pipe 30 is 0.6 L or less as in the present embodiment, a space of the oil separator 100 for receiving the separated oil is decreased. Because of this, when the amount of the separated oil is much, a problem that the oil flows into not only the oil discharge pipe 40 but also the refrigerant discharge pipe 30 may occur.

In the case of using a small oil separator according to the prior art, a bypass pipe provided in parallel to a capillary pipe and an electronic valve provided in the bypass pipe are disposed in the refrigerant circuit. So, when the amount of the oil contained in the oil-containing refrigerant is much, for example, such as during start-up of the compressor, the oil separated by the oil separator is reliably returned to the compressor by opening the electronic valve.

In contrast, the refrigerant circuit 200 according to the present embodiment is configured to surely return the separated oil to the compressor C by using the capillary pipe T that is greater in diameter than the conventional refrigerant circuit. Accordingly, since the refrigerant circuit according to the present embodiment does not require the electronic valve, it is possible to reduce the cost.

Also, the oil separator 100 according to the present disclosure is not limited to the above-described embodiments.

Figure 11:
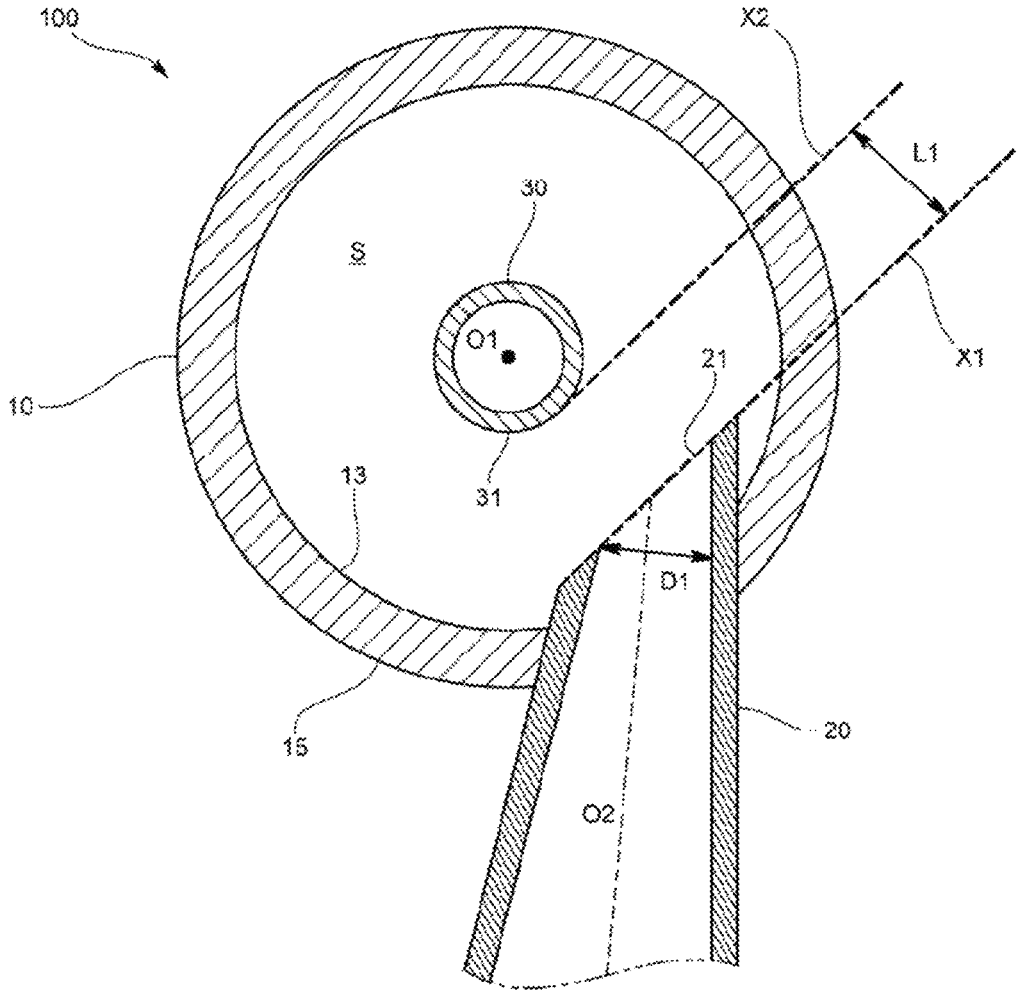
FIG. 11 is a view schematically illustrating an oil separator according to another embodiment of the present disclosure.

For example, in the above-described embodiment, the inlet pipe 20 is formed in a cylindrical pipe with a uniform cross-sectional shape. However, an oil separator 100 according to another embodiment may be formed, as illustrated in FIG. 11, so that the inlet pipe 20 has a diameter reducing portion the diameter of which is gradually reduced toward the inlet port 21.

In this case, the spacing distance L1 between the first virtual plane X1 and the second virtual plane X2 may be determined as 0.32 times or more the inner diameter D1 of the front end portion of the inlet pipe 20.

Figure 12:
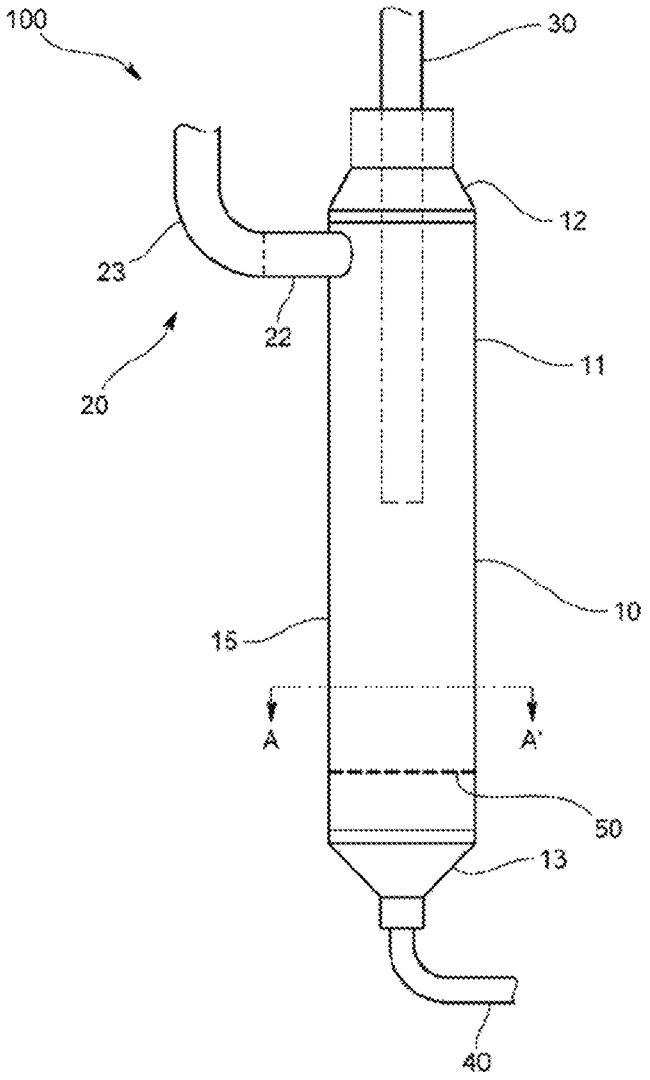
FIG. 12 is a view schematically illustrating an oil separator according to another embodiment of the present disclosure.

As another embodiment, as illustrated in FIG. 12, the oil separator 100 may be formed to further include an oil scattering prevention plate 50 that is provided in the lower portion of the inside of the container 10 and partitions the separation space S up and down.

The oil scattering prevention plate 50 may be fixed to the upper side of the lower tapered portion 13 by, for example, welding, etc., and may be formed in a plate shape with at least one oil passage hole 51 that allows the separated oil to pass through from top to bottom.

Figure 13:
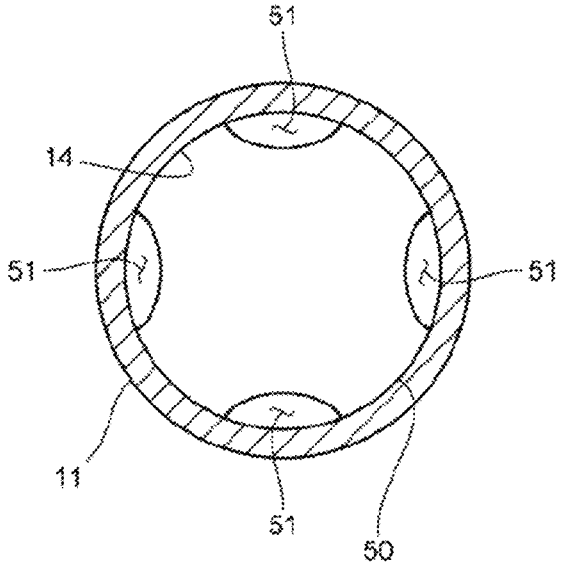
FIG. 13 is a cross-sectional view illustrating the oil separator of FIG. 12 taken along a line A-A'.

More specifically, with reference to FIG. 13, the oil scattering prevention plate 50 is formed in a circular plate shape an outer circumferential surface of which corresponds to the inner circumferential surface 14 of the container 10. The outer circumferential surface may be provided with at least one oil passage hole 51. For example, a plurality of oil passage holes 51 may be formed at equal intervals in the circumferential direction of the oil scattering prevention plate 50. In the case of FIG. 13, four oil passage holes 51 are formed in the oil scattering prevention plates 50, but the number of the oil passage hole 51 may be appropriately changed.

Figure 14:
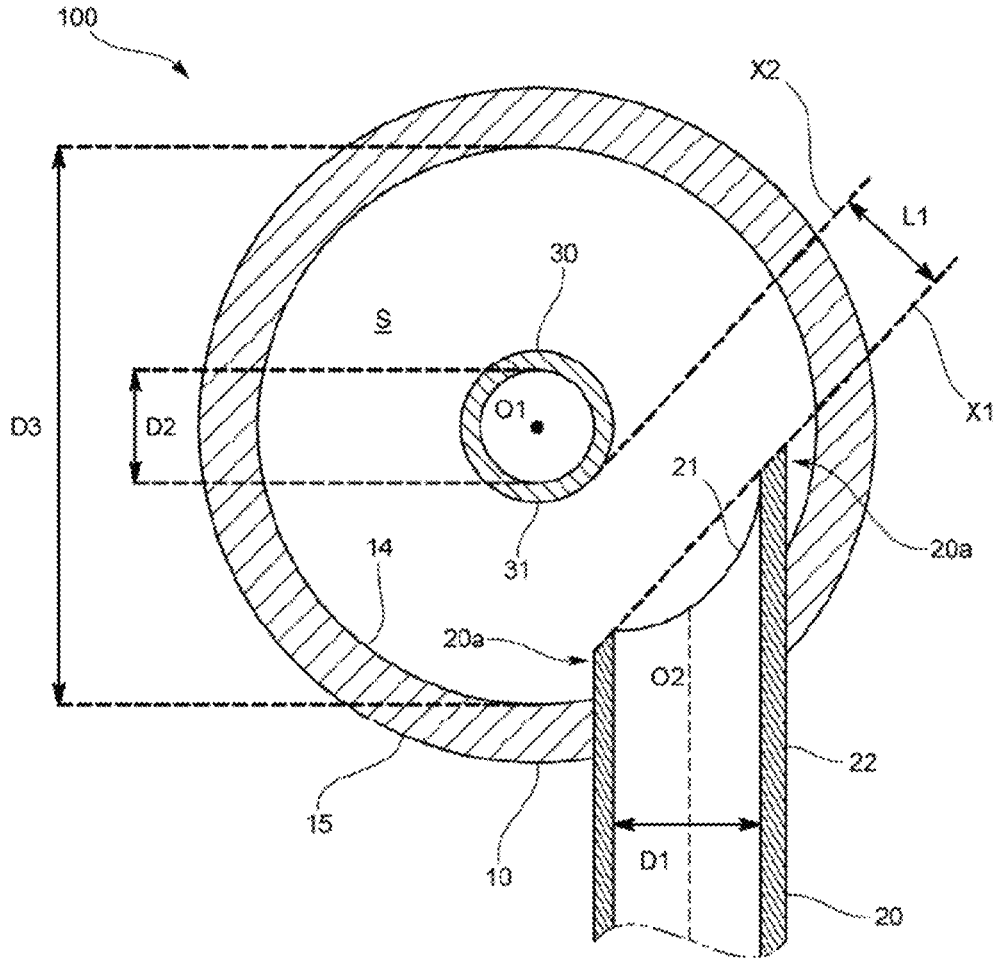
FIG. 14 is a cross-sectional view schematically illustrating an oil separator according to another embodiment of the present disclosure.

In the oil separator 100 according to the above-described embodiment, the inlet port 21 of the inlet pipe 20 is formed on the first virtual plane X1, but the shape of the inlet port 21 is not limited thereto. As illustrated in FIG. 14, the inlet port 21 of the oil separator 100 according to another embodiment may not be formed on the first virtual plane X1, but may be formed in a shape that is curved from the leading end of the inlet pipe 20 toward the inside of the inlet pipe 20.

Also, the inlet pipe of the oil separator according to the above-described embodiment is provided such that the pipe axis thereof is orthogonal to the central axis of the container 10, but the pipe axis may be disposed to be inclined downward or upward with respect to the direction orthogonal to the central axis.

Further, the oil discharge pipe of the oil separator according to the above-described embodiment is provided to penetrate through the bottom surface of the container. However, it is good if the oil discharge pipe is provided in the lower side of the container. Accordingly, the oil discharge pipe may be provided to penetrate through a lower portion of the side wall of the container.

In addition, the container of the oil separator according to the above-described embodiment is formed in a cylindrical shape, but the shape of the container is not limited thereto. The container may be formed such that a cross-section taken orthogonally to the central axis has a circular inner circumferential surface, and the appearance of the container may be formed in various shapes. For example, the outer shape of the container may be formed in a square pillar shape or a polygonal pillar shape.

While some embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. An oil separator for separating oil from oil-containing refrigerant, the oil separator comprising:

a container having an inner circumferential surface defining a cylindrical interior space;

an inlet pipe penetrating the container from an outside of the container to the interior space of the container through a hole in the container and comprising an inlet port, inclined with respect to a central axial axis of the inlet pipe, through which the oil-containing refrigerant is introduced into the interior space of the container, the inlet pipe including a diameter reducing portion in which an inner diameter of the inlet pipe is gradually reduced in a direction toward the inlet port; and a refrigerant discharge pipe provided coaxially with a central axis of the container at a top end of the container, projecting from the top end of the container toward a bottom end of the container, and comprising a discharge port that is disposed below the inlet port and allows oil-removed refrigerant to be discharged, wherein the inlet port of the inlet pipe is inclined with respect to the central axial axis of the inlet pipe to face toward the refrigerant discharge pipe so that the oil-containing refrigerant flows from the inlet pipe to only one side of the refrigerant discharge pipe, any line extending from an inner circumferential surface of the inlet port of the inlet pipe to the inner circumferential surface of the container and parallel to the central axial axis of the inlet pipe is provided entirely to one side of the refrigerant discharge pipe, and an imaginary straight line extending perpendicular to the inlet port from a center of the inlet port of the diameter reducing portion of the inlet pipe meets the refrigerant discharge pipe.

2. The oil separator of claim 1, wherein the inlet pipe has the leading end protruded into the interior space of the container, and in a cross-section of the oil separator that includes the central axial axis of the inlet pipe and is orthogonal to the central axis, the leading end of the inlet pipe is on a first virtual plane parallel to the central axis, and a spacing distance between the first virtual plane and a second virtual plane that is parallel to the first virtual plane and is tangent to the outer circumferential surface of the refrigerant discharge pipe is at least 0.32 times the inner diameter of the inlet pipe at the inlet port.

3. The oil separator of claim 2, wherein the first virtual plane is inclined with respect to the central axial axis of the inlet pipe, and the leading end of the inlet port has an inclined rim, which is on the first virtual plane, facing toward the refrigerant discharge pipe.

4. The oil separator of claim 2, wherein a distance between the outer circumferential surface of the refrigerant discharge pipe and the inner circumferential surface of the container is in a range of 1.0 to 2.0 times an inner diameter of the refrigerant discharge pipe.

5. The oil separator of claim 2, wherein the inner diameter of the inlet pipe is in a range of 0.16 to 0.44 times an inner diameter of the container.

6. The oil separator of claim 2, wherein the inner diameter of the inlet pipe is in a range of 9.5 mm to 22.4 mm, and in a cross-section that includes the central axis of the container and is orthogonal to the central axial axis of the inlet pipe, a spacing distance from the central axial axis of the inlet pipe to a portion of the inner circumferential surface of the container that is opposite to the central axis with respect to the central axial axis is in a range of 10.6 mm to 13.2 mm.

7. The oil separator of claim 1, wherein a height from the discharge port to a center of the inlet port is in a range of 3.0 to 4.5 times the inner diameter of the inlet pipe at the inlet port.

8. The oil separator of claim 7, wherein a distance between the outer circumferential surface of the refrigerant discharge pipe and the inner circumferential surface of the container is in a range of 1.0 to 2.0 times an inner diameter of the refrigerant discharge pipe.

9. The oil separator of claim 7, wherein the inner diameter of the inlet pipe at the inlet port is in a range of 0.16 to 0.44 times an inner diameter of the container.

10. The oil separator of claim 7, wherein the inner diameter of the inlet pipe at the inlet port is in a range of 9.5 mm to 22.4 mm, and in a cross-section that includes the central axis of the container and is orthogonal to the central axial axis of the inlet pipe, a spacing distance from the central axial axis of the inlet pipe to a portion of the inner circumferential surface of the container that is opposite to the central axis with respect to the central axial axis is in a range of 10.6 mm to 13.2 mm.

11. The oil separator of claim 1, wherein the container comprises a cylindrical main body portion, and an upper tapered portion provided at a top end of the main body portion and decreasing in diameter along an upward direction, and a height from the top end of the main body portion to the central axial axis of the inlet pipe is lower than a height of the upper tapered portion.

12. The oil separator of claim 1, wherein the container comprises a lower tapered portion provided at a bottom end of the main body portion and decreasing in diameter along a downward direction, the lower tapered portion receives the separated oil, and the discharge port of the refrigerant discharge pipe is provided above the lower tapered portion.

13. The oil separator of claim 1, wherein the inlet pipe comprises:

a front end portion, in which the inlet port is formed and which penetrates through a side wall of the container; and a rear end portion provided at an upstream side of the front end portion, bent from the front end portion, and extending in an upper side.

14. The oil separator of claim 1, further comprising:

an oil scattering prevention plate provided in a lower portion of an inside of the container, partitioning the inside of the container up and down, and provided with at least one oil passage hole through which oil separated from the oil-containing refrigerant passes.

15. The oil separator of claim 14, wherein the oil scattering prevention plate has an outer circumferential surface and is formed in a circular plate shape corresponding to the inner circumferential surface of the container, and the at least one oil passage hole is formed in the outer circumferential surface of the oil scattering prevention plate.

16. The oil separator of claim 1, wherein in a cross-section that includes the central axial axis of the inlet pipe and is orthogonal to the central axis, an inner surface of the inlet pipe that is most proximate to the central axis of the container extends on and along a virtual line tangential to or entirely outside of an outer circumference of the refrigerant discharge pipe.

17. An air conditioner comprising:

an oil separator configured to separate oil from oil-containing refrigerant of the air conditioner, the oil separator comprising:

a container having an inner circumferential surface defining a cylindrical interior space;

an inlet pipe penetrating the container from an outside of the container to the interior space of the container through a hole in the container and comprising an inlet port, inclined with respect to a central axial axis of the inlet pipe, through which the oil-containing refrigerant is introduced into the interior space of the container, the inlet pipe including a diameter reducing portion in which an inner diameter of the inlet pipe is gradually reduced in a direction toward the inlet port; and a refrigerant discharge pipe provided coaxially with a central axis of the container at a top end of the container, projecting from the top end of the container toward a bottom end of the container, and comprising a discharge port that is disposed below the inlet port and allows oil-removed refrigerant to be discharged, wherein the inlet port of the inlet pipe is inclined with respect to the central axial axis of the inlet pipe to face toward the refrigerant discharge pipe so that the oil-containing refrigerant flows from the inlet pipe to only one side of the refrigerant discharge pipe, any line extending from an inner circumferential surface of the inlet port of the inlet pipe to the inner circumferential surface of the container and parallel to the central axial axis of the inlet pipe is provided entirely to one side of the refrigerant discharge pipe, and an imaginary straight line extending perpendicular to the inlet port from a center of the inlet port of the diameter reducing portion of the inlet pipe meets the refrigerant discharge pipe.

18. The air conditioner of claim 17, wherein the inlet pipe has the leading end protruded into the interior space of the container, and in a cross-section of the oil separator that includes the central axial axis of the inlet pipe and is orthogonal to the central axis, the leading end of the inlet pipe is on a first virtual plane parallel to the central axis, and a spacing distance between the first virtual plane and a second virtual plane that is parallel to the first virtual plane and is tangent to the outer circumferential surface of the refrigerant discharge pipe is at least 0.32 times the inner diameter of the inlet pipe at the inlet port.

19. The air conditioner of claim 17, wherein a height from the discharge port to a center of the inlet port is in a range of 3.0 to 4.5 times the inner diameter of the inlet pipe.

20. The air conditioner of claim 17, wherein the inlet pipe comprises:

a front end portion, in which the inlet port is formed and which penetrates through a side wall of the container; and a rear end portion provided at an upstream side of the front end portion, bent from the front end portion, and extending in an upper side.

* * * * *